US010370887B2

(12) United States Patent
Lange

(10) Patent No.: US 10,370,887 B2
(45) Date of Patent: Aug. 6, 2019

(54) HIDDEN MOTORIZED SYSTEM FOR OPENING AND CLOSING A WINDOW

(71) Applicant: Rick K. Lange, Dorchester, MA (US)

(72) Inventor: Rick K. Lange, Dorchester, MA (US)

( * ) Notice: Subject to any disclaimer, the term of this patent is extended or adjusted under 35 U.S.C. 154(b) by 140 days.

(21) Appl. No.: 15/653,330

(22) Filed: Jul. 18, 2017

(65) Prior Publication Data

US 2018/0023333 A1 Jan. 25, 2018

Related U.S. Application Data

(60) Provisional application No. 62/366,380, filed on Jul. 25, 2016.

(51) Int. Cl.

*E05F 15/665* (2015.01)
*E05F 15/77* (2015.01)
*E05D 13/00* (2006.01)

(52) U.S. Cl.

CPC ..... *E05F 15/665* (2015.01); *E05D 13/006* (2013.01); *E05D 13/1207* (2013.01); *E05D 13/1223* (2013.01); *E05F 15/77* (2015.01); *E05Y 2201/422* (2013.01); *E05Y 2201/434* (2013.01); *E05Y 2201/716* (2013.01); *E05Y 2201/722* (2013.01); *E05Y 2400/354* (2013.01); *E05Y 2600/41* (2013.01); *E05Y 2600/46* (2013.01); *E05Y 2900/148* (2013.01)

(58) Field of Classification Search

CPC ..... E06B 3/4415; E05F 15/77; E05F 15/665; E05F 15/67; E05F 15/673; E05F 15/635

See application file for complete search history.

(56) References Cited

U.S. PATENT DOCUMENTS 3,436,863 A * 4/1969 Peelle, Jr. ..... E05F 15/665 187/320
4,147,073 A * 4/1979 Mercier ..... E05F 15/673 74/424.78
5,301,734 A * 4/1994 Opel ..... E05D 15/22 160/100
5,440,837 A * 8/1995 Piltingsrud ..... E05D 15/22 49/139
5,893,242 A * 4/1999 Perron ..... E05F 11/36 52/202
6,216,394 B1 * 4/2001 Fenelon ..... E05F 15/689 49/349
6,343,436 B1 * 2/2002 Milano, Jr. ..... E05F 15/67 49/362
9,970,225 B2 * 5/2018 Wynder ..... E05D 15/16
2007/0011946 A1 * 1/2007 Mullen ..... E05F 15/665 49/325

(Continued)

*Primary Examiner* — Brian D Mattei

(74) *Attorney, Agent, or Firm* — Morse, Barnes-Brown & Pendleton, P.C.; Sean D. Detweiler, Esq.

(57) ABSTRACT

A system and method of use relating to a hidden motorized system for use in windows that can reliability and consistently open and close the window via remote operation. Specifically, a motorized system is disposed inside a window in a manner without requiring unsightly modifications to the window. The motorized system can be controlled via wireless remote or wired remote switch. The entire system fits within a conventional window, such as a single or double hung window, in a manner that is hidden from view, thereby keeping the conventional ornamental look of the window.

20 Claims, 12 Drawing Sheets

(56) References Cited

U.S. PATENT DOCUMENTS

| | | | | |
|---|---|---|---|---|
| 2010/0122493 | A1* | 5/2010 | Burrows | E05D 13/1207 49/358 |
| 2012/0023827 | A1* | 2/2012 | Hancock | E05F 15/635 49/360 |
| 2013/0318875 | A1* | 12/2013 | Hansen | E05F 15/665 49/349 |
| 2014/0150346 | A1* | 6/2014 | DeBoer | E06B 3/4415 49/414 |
| 2014/0230331 | A1* | 8/2014 | Kellum, III | E05D 13/06 49/352 |
| 2015/0020617 | A1* | 1/2015 | Neumann | F16H 19/04 74/30 |
| 2016/0305181 | A1* | 10/2016 | Valverde | E05F 15/72 |
| 2017/0009507 | A1* | 1/2017 | Newman | E05F 11/48 |
| 2017/0051551 | A1* | 2/2017 | Smart | E05D 13/14 |
| 2017/0074021 | A1* | 3/2017 | Rodems | E05D 15/08 |
| 2017/0101816 | A1* | 4/2017 | Kozonasky | E05F 15/77 |
| 2017/0130512 | A1* | 5/2017 | McKenna | E05D 13/14 |
| 2017/0191299 | A1* | 7/2017 | Hariprasad | E06B 3/4415 |
| 2018/0238097 | A1* | 8/2018 | Plummer | E05F 15/603 |

* cited by examiner

HIDDEN MOTORIZED SYSTEM FOR OPENING AND CLOSING A WINDOW

CROSS-REFERENCE TO RELATED APPLICATION(S)

This application claims priority to, and the benefit of, U.S. Provisional Application No. 62/366,380, filed Jul. 25, 2016, for all subject matter common to both applications. The disclosure of said provisional application is hereby incorporated by reference in its entirety.

FIELD OF THE INVENTION

The present invention relates to a hidden motorized system suitable for use in a window. In particular, the present invention relates to a hidden motorized system suitable for inclusion in a window in such a way that enables infinitely variable remote operation of window positions between fully open and fully closed without requiring substantial modifications to the outward appearance of the window structure.

BACKGROUND

There are numerous different types of windows. Some windows may even include some form of automation, such as a tilt window, to open and close the window. However, there are shortcomings as to the availability of automation for certain window types, including double or single hung windows, because of various difficulties in providing the necessary force to reliability open and close double hung windows without requiring unsightly modifications to the window.

SUMMARY

There is a need for a motorized system for use in windows that can reliability and consistently open and close the window via remote operation without requiring unsightly modifications to the window that would noticeably alter the outward appearance of the winder relative to conventional windows without such a motorized system. The present invention is directed toward further solutions to address this need, in addition to having other desirable characteristics. Specifically, a motorized system is disposed inside the non-glass components of a window in a manner that hides its existence to the ordinary observer (i.e., unsightly modifications to the window are not required).

In accordance with example embodiments of the present invention, a system for use in automating a window is provided. The system includes a motor having a drive shaft configured for mounting inside a rail of a window sash of the window. The system also includes at least one main shaft configured for mounting inside the rail of the window sash and mechanically coupled with the drive shaft when in operable configuration. The system further includes a gear disposed at a first end of the main shaft, distal from the motor and a corresponding gear receiver configured for mounting along the window channel of the window frame within which the window sash is slidably mounted, wherein the gear receiver meshes with the gear. When mounted inside the window in operable configuration, the motor having a drive shaft moves the window along infinitely variable positions between open and closed.

In accordance with aspects of the present invention, the window is a double-hung window configuration having the window sash slidably coupled with a window channel of a window frame. The gear can be a race or pinion gear and the gear receiver comprises a gear rack.

In accordance with aspects of the present invention, the system further includes a power source configured for mounting inside the window sash in electrical communication with the motor. The system can further include a wireless communication and control device operably coupled with the motor, the wireless communication and control device configured to communicate wirelessly with a remote and control operation of the motor in accordance with wireless signals received from the remote. The wireless communication and control device can be operable to control the direction and position of the motor having a drive shaft. The system can further include at least two limit switches configured to control an operation of the window in both the up and down positions. The at least two limit switches break the forward current to the motor when a small stop block depresses at least one of the at least two limit switches.

In accordance with aspects of the present invention, the system further includes a hidden balance system comprising a pulley and cable in combination with a tension spring. When the window sash is lowered to a fully closed position, the cable is in tension and pulls on the tension spring, extending the tension spring. When the window is fully closed, the spring applies a force to the window sash via the cable, lessening a force required to move the window sash upward.

In accordance with aspects of the present invention, the motor is electrically coupled with a power source via an electrically conductive roller ball in contact with a brass strip embedded in a side of the window sash 218. The power source electrically couples with the roller ball, which in turn makes rolling contact with the brass strip, which in turn is electrically coupled with the motor.

In accordance with example embodiments of the present invention, a method is provided. The method includes using a remote control device, sending a signal to a wireless receiver disposed in communication with a motorized system mounted inside a window, the signal indicating a command to the motorized system to move the window to a position ranging between and including fully open and fully closed. The motorized system receives the signal and activating a motor to implement the received command and the window moves to the position commanded.

In accordance with aspects of the present invention, the window is a double-hung window configuration.

In accordance with example embodiments of the present invention, a double-hung window is provided. The double-hung window includes a window sash slidably coupled with a window channel of a window frame and a motor having a drive shaft and mounted inside a rail of the window sash. The window also includes at least one main shaft mounted inside the rail of the window sash and mechanically coupled with the drive shaft when in operable configuration. The window further includes a race or pinion gear disposed at a first end of the main shaft, distal from the motor and a gear rack mounted along the window channel of the window frame within which the window sash is slidably mounted. The race or pinion gear meshes with the gear rack.

In accordance with aspects of the present invention, the window further includes a power source mounted inside the window sash in electrical communication with the motor. The system can also include a wireless communication and control device operably coupled with the motor, the wireless communication and control device configured to communicate wirelessly with a remote control and control operation of the motor in accordance with wireless signals received from the remote control. The wireless communication and control device is operable to control the direction and position of the motor. The remote control can include a dedicated hardware device. The remote control can includes an application operating on a mobile device.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1:
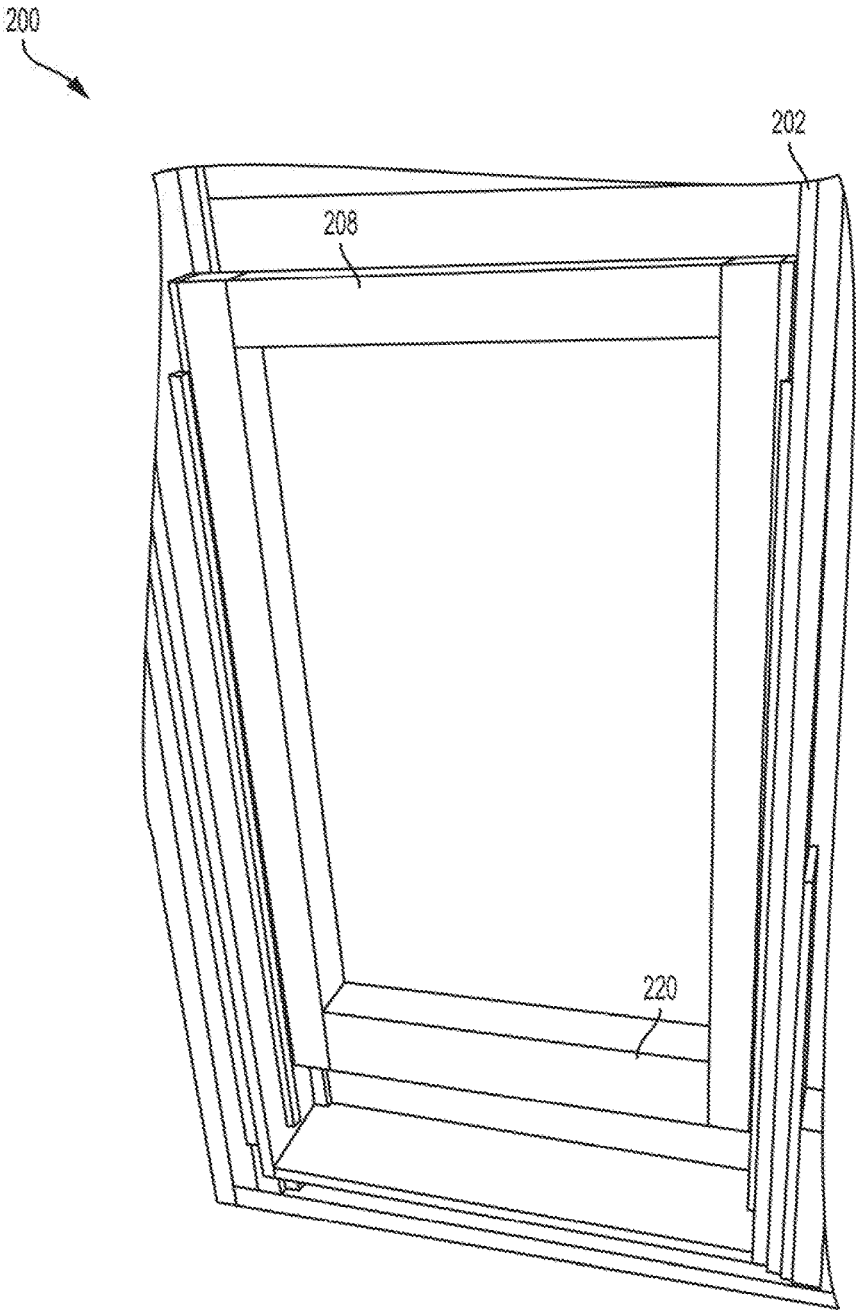
FIG. 1 is an image of a motorized system for a window, according to an embodiment of the present invention.
Figure 2A:
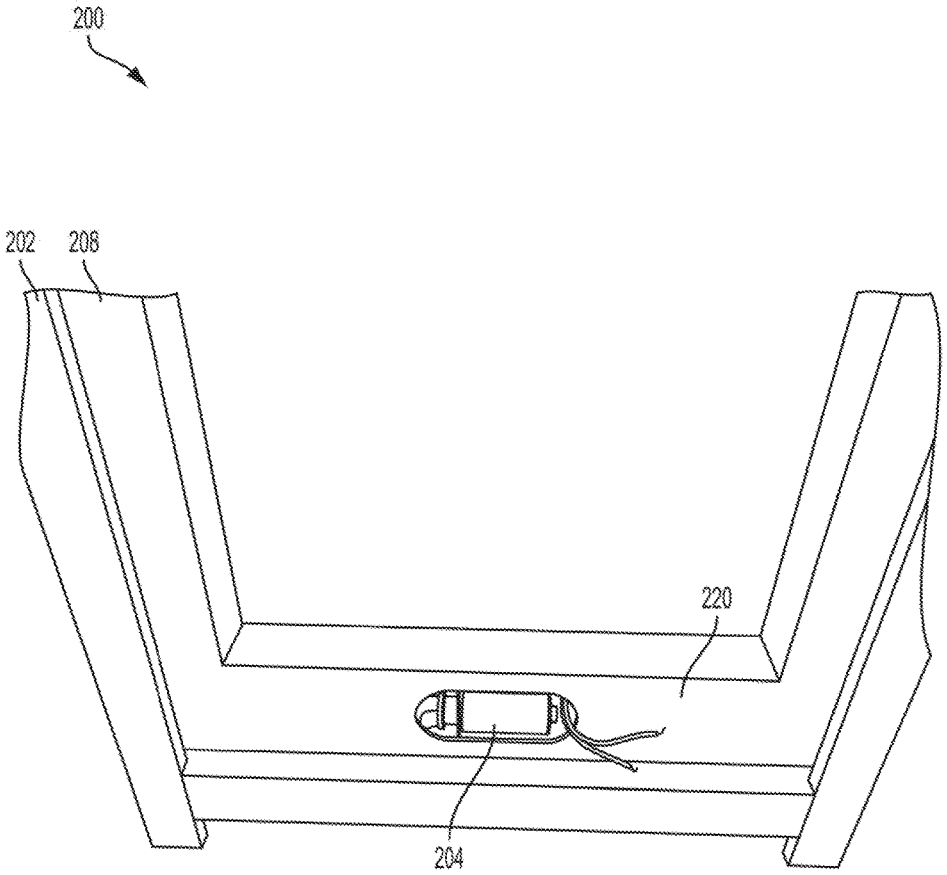
FIG. 2A is an image of the system installed in a bottom rail of a double-hung window lower sash, in accordance with an example embodiment of the present invention.
Figure 2B:
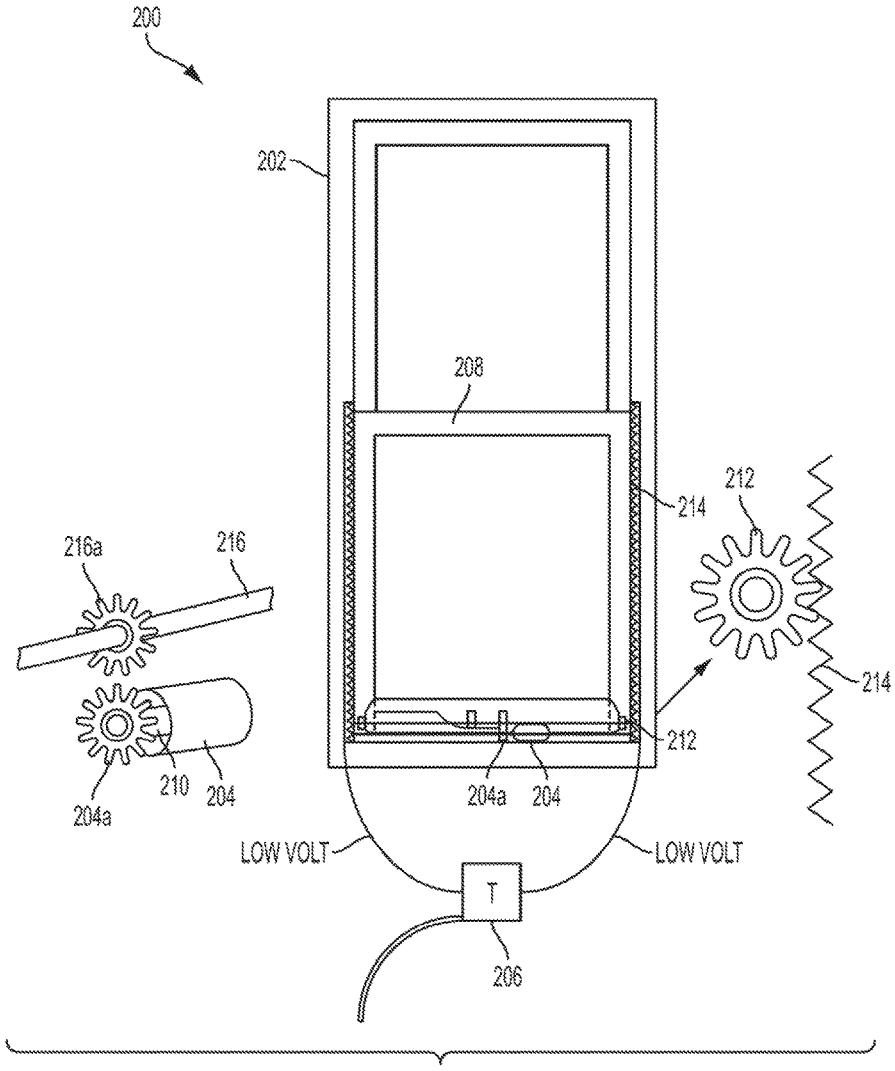
FIG. 2B is a diagrammatic illustration of the system installed in a bottom rail of a double-hung window lower sash, in accordance with an example embodiment of the present invention.

An illustrative embodiment of the present invention relates to a system for use in automating the opening and closing of a window. The system includes a linear actuator configured for mounting inside the window. When mounted inside the window in operable configuration, the linear actuator moves the window along infinitely variable positions between open and closed. The window can be in a double-hung window configuration having a window sash slidably coupled with a window channel of a window frame. In such a window configuration, the linear actuator can be in the form of a motor having a drive shaft configured for mounting inside a rail of the window sash. At least one main shaft is configured for mounting inside the rail of the window sash and mechanically coupled with the drive shaft when in operable configuration. A gear is disposed at a first end of the main shaft (or on both ends of the main shaft), distal from the motor. A corresponding gear receiver is configured for mounting along the window channel of the window frame within which the window sash is slidably mounted. The gear receiver meshes with the gear. In this configuration, the system enables motorized control of the double-hung window, via remote control, to move the window between, e.g., fully open and fully closed positions, with infinite variability of positions therebetween, and without requiring unsightly modification of the classic or conventional double-hung window look as viewed by the ordinary observer and understood by those of skill in the art. Although the disclosure refers to an embodiment for a double-hung window, as would be appreciated by one skilled in the art, the present invention could be adjusted to work with multiple different window designs without departing from the scope of the present invention. In addition, other forms of linear actuators providing the same mechanical functionality of powered linear movement are also contemplated and considered to fall within the scope of the present invention.

FIGS. 1 through 11B illustrate an example embodiment or embodiments of a motorized system 200 for opening and closing a window 202, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

As shown in FIGS. 1 through 11B, in a double-hung window 202 configuration, the system 200 includes a motor 204 with a power source 206. In accordance with an example embodiment of the present invention, the power source 206 is mounted inside of the sash 208 of the window 202, but can be mounted outside of the window 202 (with power being conveyed by a roller catch in contact with a brass strip). The power source 206 is wired to a motor 204. The motor 204 has a drive shaft 210 extending out from the motor 204 with a pinion gear 204*a* attached thereto. The pinion gear 204*a* in turn meshes with another pinion gear 216*a* positioned on a main shaft 216. As would be appreciated by one skilled in the art, any combination of gears can be utilized for the pinion gears 204*a*, 216*a*. For example, the pinion gears 204*a*, 216*a* can be spur gears. The main shaft 216 is rotatably coupled inside the sash 218 of the window 202, along a rail 220, as depicted in FIGS. 1-4. It should be noted that the configuration of the main shaft 216 and related components shown in FIGS. 1-12B is mounted in the bottom rail 220 of the bottom sash 218 of the double-hung window 202, but that the system can be mounted in either the top or bottom rail of the top or bottom sash of the double-hung window 202. In operation, whichever sash 218 (lower or upper) the system is mounted in is the sash 218 that is controlled by the system 200.

Figure 9:
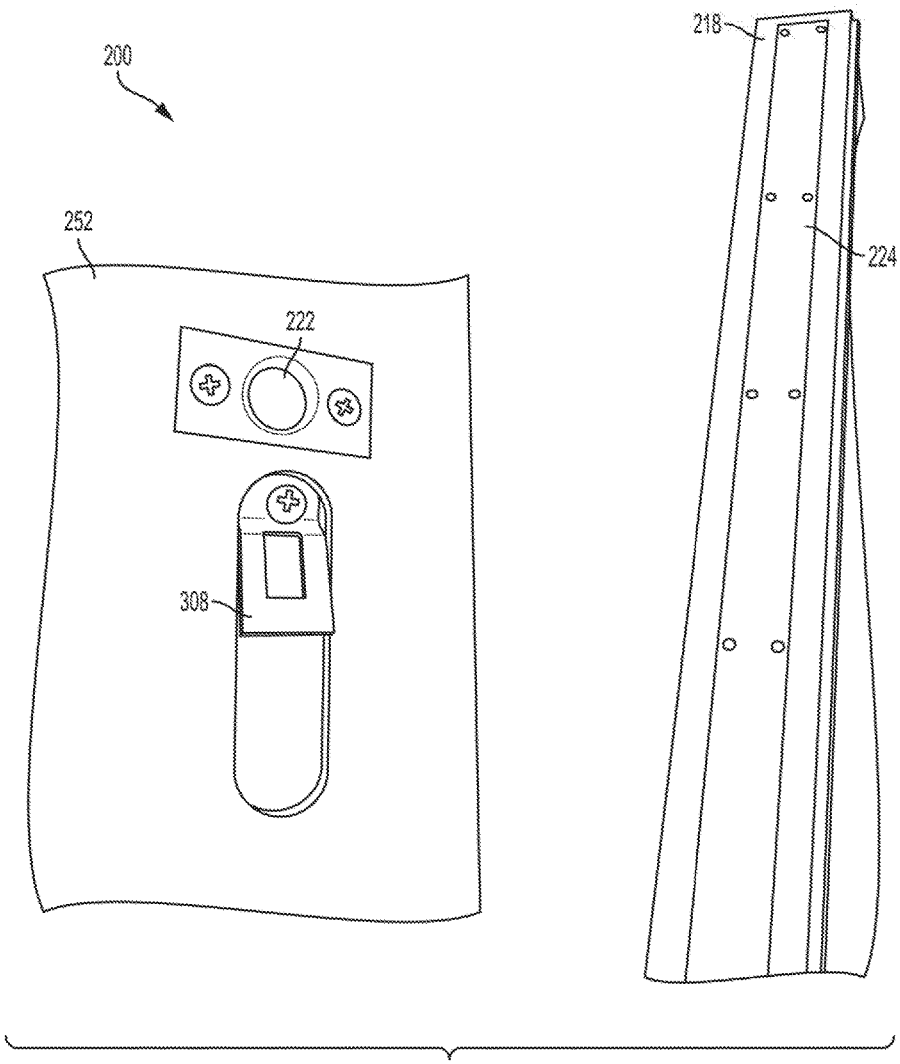
FIG. 9 shows an images of a roller ball electrical contact and a catch, both mounted on a side jamb of a window frame, in accordance with one example embodiment of the present invention.

The motor 204 is electrically coupled with a power source 206 via an electrically conductive roller ball 222 in contact with a brass strip 224 embedded in the side of the sash 218 (see FIG. 9). In accordance with an example embodiment of the present invention, the power source 206 is a transformer. For example, the power source 206 can be a transformer ranging from 12V to 24V. In accordance with an example embodiment of the present invention, the power source 206 is split into two parts using diodes 240 which allow current to flow in only forward or reverse direction, as discussed in greater detail with respect to FIG. 10. The current is transferred to the sash 218 using the brass roll ball 222, catch 308, and brass plate 224 running along the sash 218. In particular, the power source 206 electrically couples with the roller ball 222, which in turn makes rolling contact with the brass strip 224, which in turn is electrically coupled with the motor 204. The power source 206 provides power to as many as six windows in a typical installation. Optionally, a backup battery can be disposed inside the sash 218 in addition to the power source 206. Additionally, a backup battery can be placed at the location of the power source 206, as would be understood by one of skill in the art. The battery backup provides a redundant power source in the event of a power failure to ensure safe operation of the system 200.

The motor 204 is also in operable communication with a wireless communication and control device (not depicted). The wireless communication and control device is capable of wireless communication with a remote control. The remote control can be a dedicated hardware device, or can be implemented in other ways such as in the form of an application operating on a mobile device, e.g., a smartphone. The wireless communication between the remote control and the wireless communication and control device can occur using any desired wireless protocol, including but not limited to WiFi, Bluetooth, Low Energy Bluetooth, LoRa, or the like. The wireless communication and control device operates to receive a signal from the remote and control operation of the motor 204 in terms of both activation and direction. For example, the wireless communication and control device can control the motor 204 to activate, rotate the drive shaft 210 in a clockwise direction, stop, and/or rotate the motor 204 in a counter-clockwise direction. Depending on the gear train between the drive shaft 210 and the main shaft 216 (of which there can be many different operable combinations of gears to effect the desired drive ratio for powering the window movement based on the motor size), clockwise rotation of the motor 204 drive shaft 210 will cause movement of the window sash 218 vertically in one direction (up or down) and counter-clockwise rotation of the motor 204 drive shaft 210 will cause movement of the window sash 218 in the opposite vertical direction.

Figure 10:
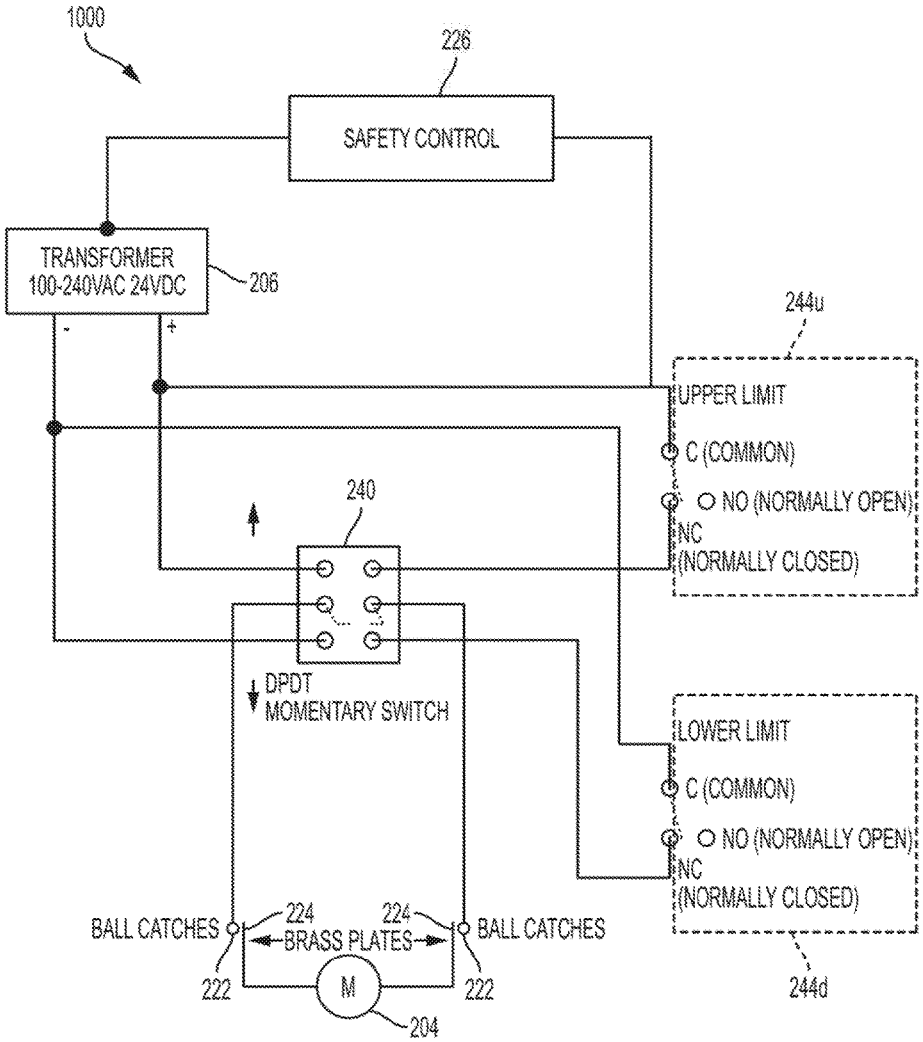
FIG. 10 shows a safety control mechanism including limit switches, in accordance with one example embodiment of the present invention.

In accordance with an example embodiment of the present invention, the motor 204 is coupled with a safety control 226, as depicted in FIG. 10, to monitor motor activity and either stop or reverse motor 204 direction when too much resistance is encountered in attempting to move the window sash 218. More specifically, soft stop shock absorbers 228 can be placed anywhere that contact is made when the window sash 218 reaches a fully open or fully closed position (e.g., along the bottom of the sash as a weather strip). As the sash 218 approaches the final position, the foam or rubber stop makes contact first, thus increasing the workload on the motor 204. The increased workload is sensed by the safety control 226, and the safety control 226 shuts off power to the motor 204. The motor 204 workload will increase any time there is an obstacle placed in front of the moving sash 218, thus the safety control 226 will shut off power to the motor 204 whenever there is something obstructing the pathway of the sash 218, thereby providing a safety mechanism. In situations where the workload increases because an object obstructs the pathway of the moving window sash 218, and the safety control 226 halts the movement of the window sash 218 for safety reasons. Thereafter, a user can manually reverse the direction that the window sash 218 was travelling and remove the object blocking the movement path. The system 200 then automatically resets and can be activated to move the window sash 218 again via the remote control.

In accordance with an example embodiment of the present invention, the safety control 226 utilizes a plurality of switches 244*u*, 244*d* to control the motion of the sash 218. FIG. 10 depicts an example circuit 1000 diagram for implementation of the safety control 226 and the plurality of switches 244*u*, 244*d*. In particular, as depicted in FIG. 10, the present invention uses two sets of limit switches 244*u* and 244*d* as a means of controlling the operation of the window 202 in both the up and down positions. If a limit switch 244*u*, 244*d* is activated while the window 202 is moving, the motor 204 will stop, avoiding damage to the window 202 or surrounding area. The switches 244*u*, 244*d* break the forward current to the motor 204 when a small stop block 242*u* depresses the micro switch 244*u* in the going up direction. Similarly, the stop block 242*d* depresses the micro switch 244*d* in the going down position and stops the current to the motor 204 in the reverse direction. In accordance with an example embodiment of the present invention, the circuit 1000 can include a control relay 140 to handle the signals between the switches 244*u*, 244*d*, and the motor 204. As would be appreciated by one skilled in the art, the safety control 226 can include any combination of mechanisms and devices to detect movement of the window sash 218. For example, the switches 224*u*, 224*d* can work in conjunction with diodes.

Continuing with FIGS. 1-11B, the main shaft 216 extends in at least one direction to the edge of the window sash 218, and terminates with a race or pinion gear 212 (e.g., a spur gear). In the illustrative embodiment shown, the main shaft 216 extends in both horizontal directions from the motor, terminating in each direction with a race or pinion gear 212 at the edge of the window sash 218.

The race or pinion gears 212 on each side of the window sash 218 mesh with a gear rack 214 disposed in a channel 230 of the window 202 frame. The channel 230 slidably holds the window sash 218, enabling freedom of movement up or down to open or close the window 202. As the race or pinion gear 212 is meshed with the gear rack 214, rotational movement of the motor 204 drive shaft 210 mechanically translates to rotational movement of the race or pinion gears 212 at the terminal ends of the main shaft 216 distal from the motor 204, which translates into linear movement along the gear rack 214. Such linear movement results in the window sash 218 moving up or down in the window channel 230, as controlled by the communication and control device.

Figure 3:
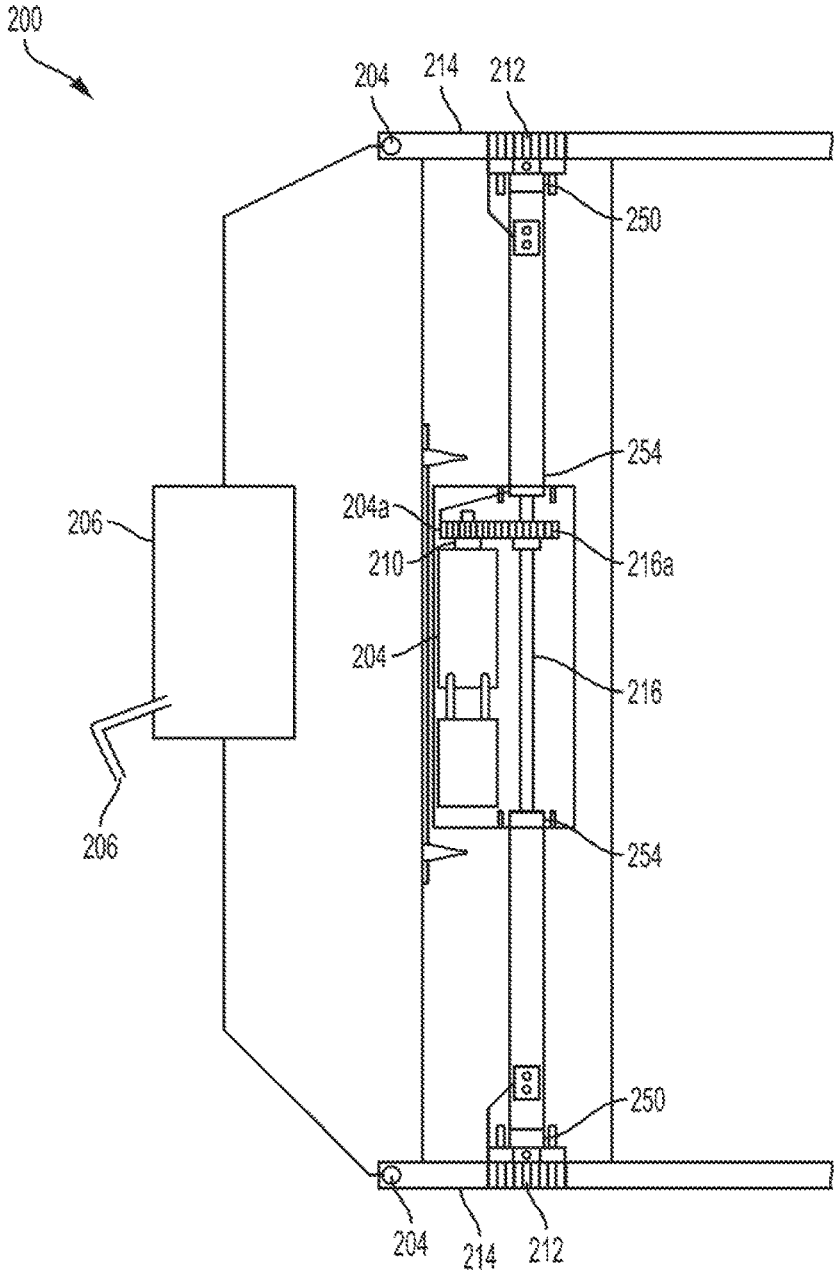
FIG. 3 is a side section view of the system of FIG. 1, in accordance with an example embodiment of the present invention.
Figure 4:
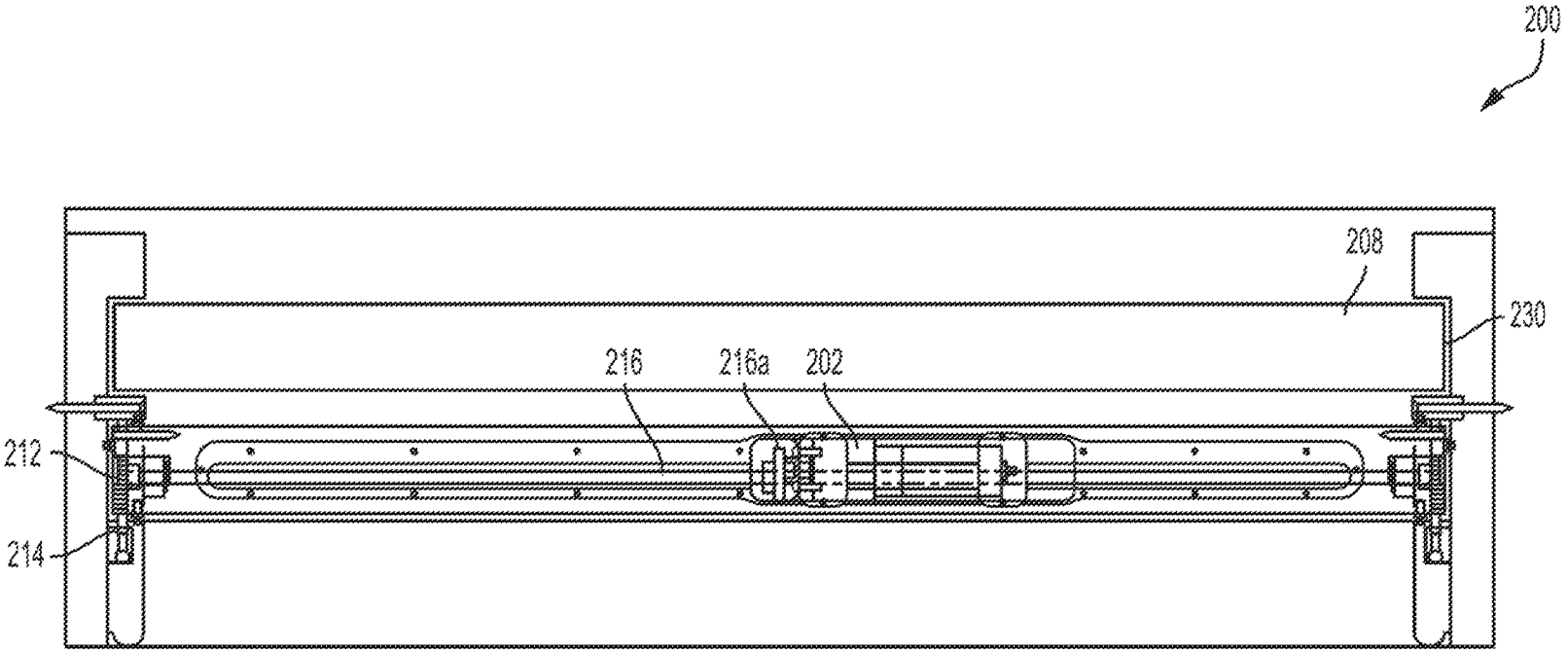
FIG. 4 is a bottom section view of the system of FIG. 1, in accordance with an example embodiment of the present invention.
Figure 5:
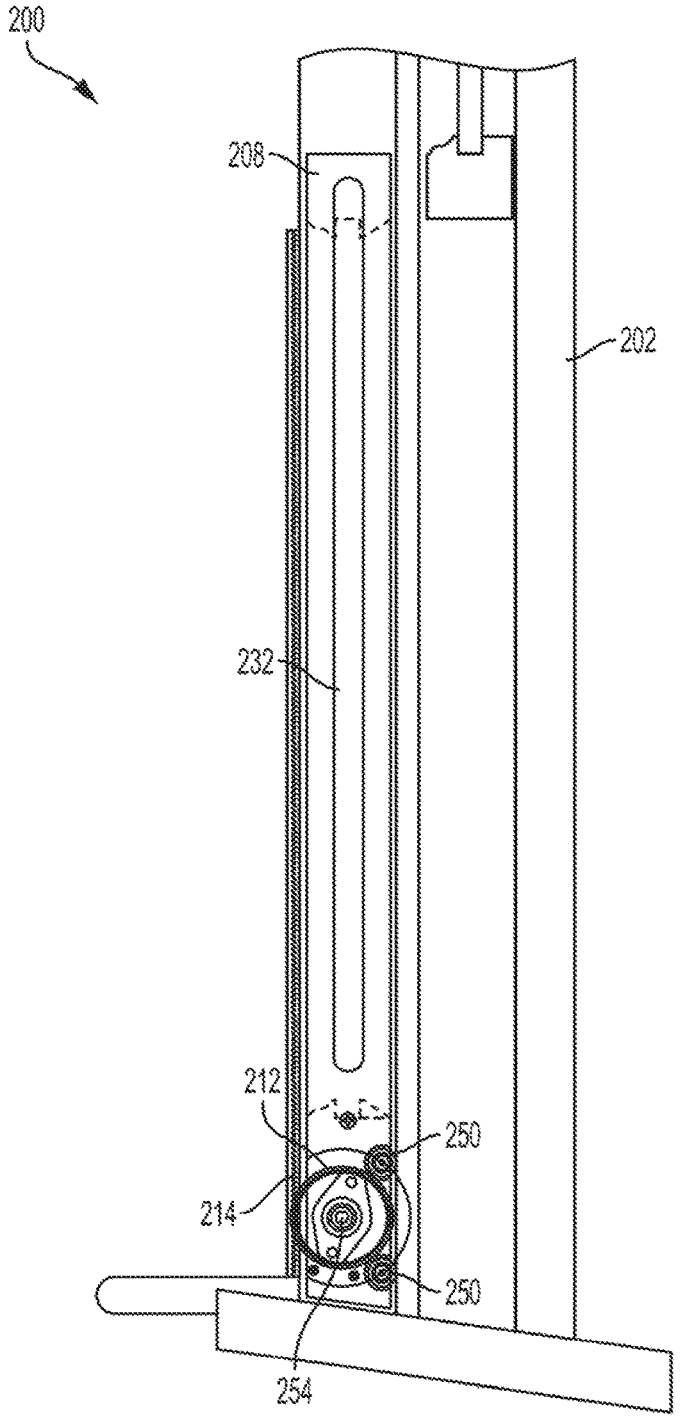
FIG. 5 is an end view of the sash gear configuration and sleeper bearings of the system of FIG. 1, in accordance with an example embodiment of the present invention.
Figure 6:
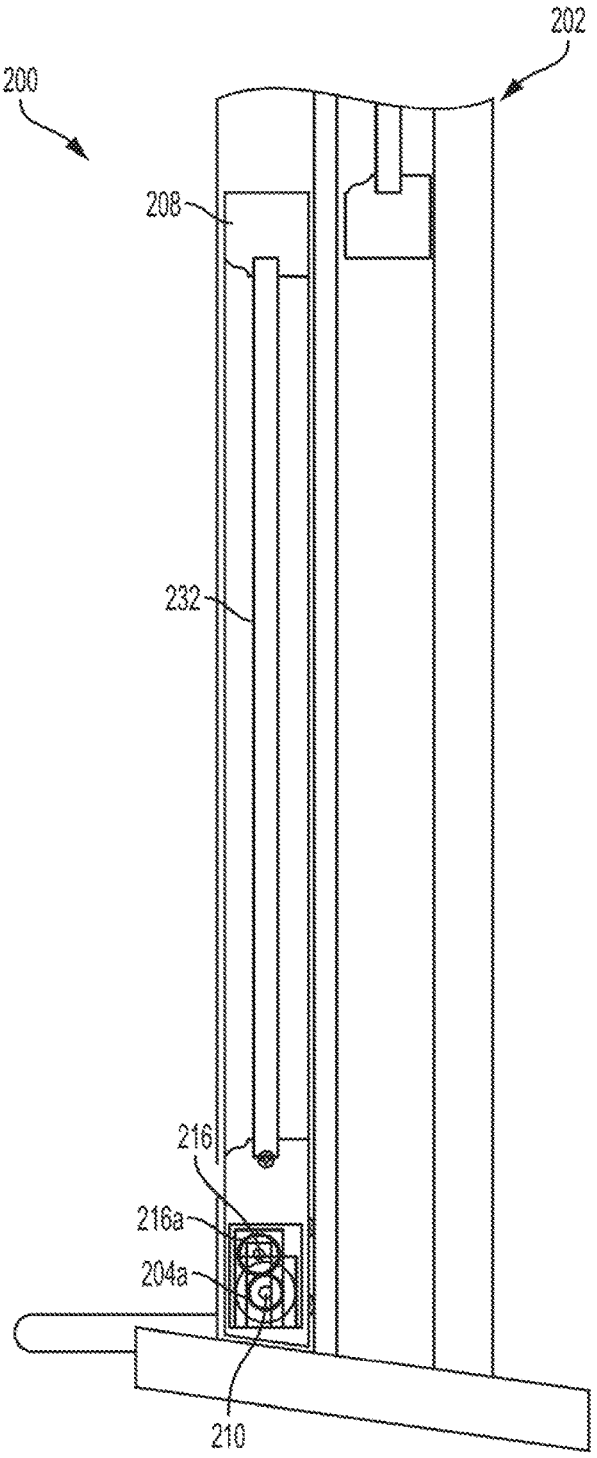
FIG. 6 is a vertical sectional view of the gear, drive shaft, and motor configuration of the system of FIG. 1, in accordance with an example embodiment of the present invention.
Figure 7:
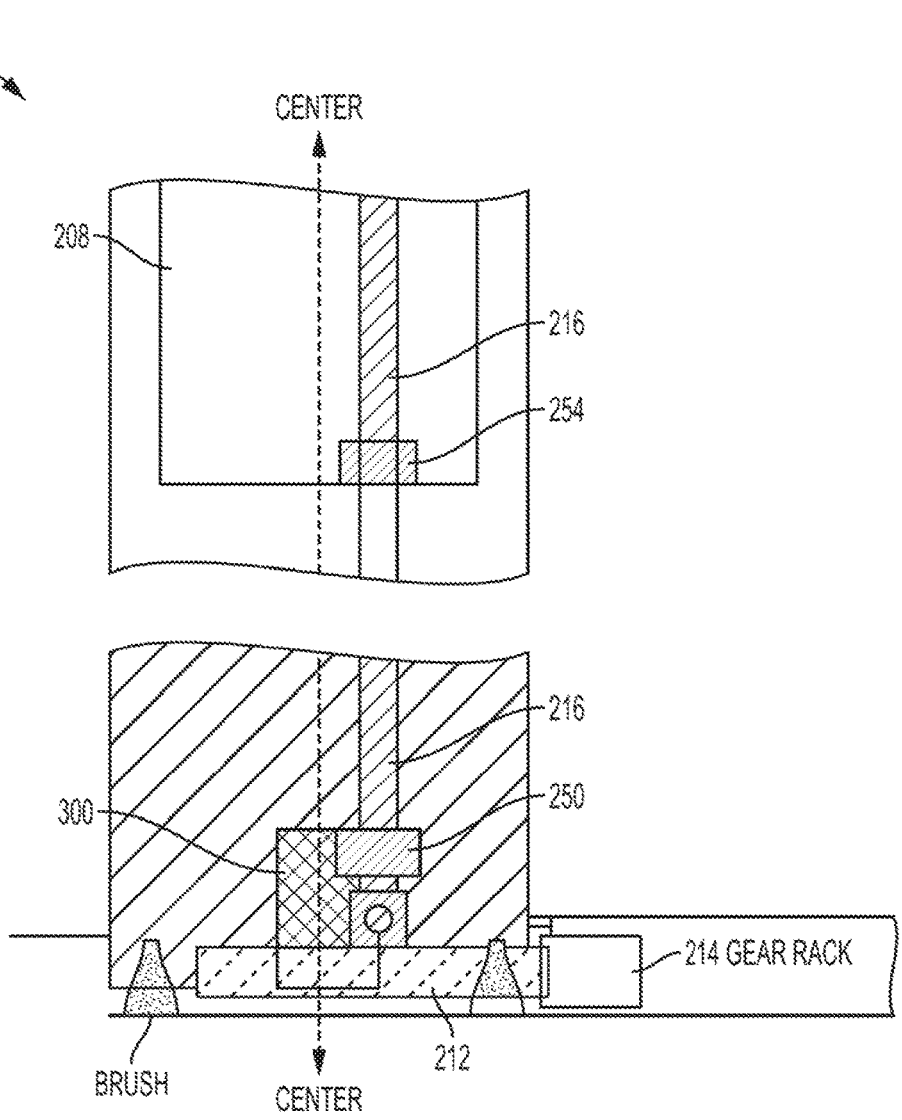
FIG. 7 is a diagrammatic illustration of an end gear at the end of a main shaft, in accordance with an example embodiment of the present invention.
Figure 8:
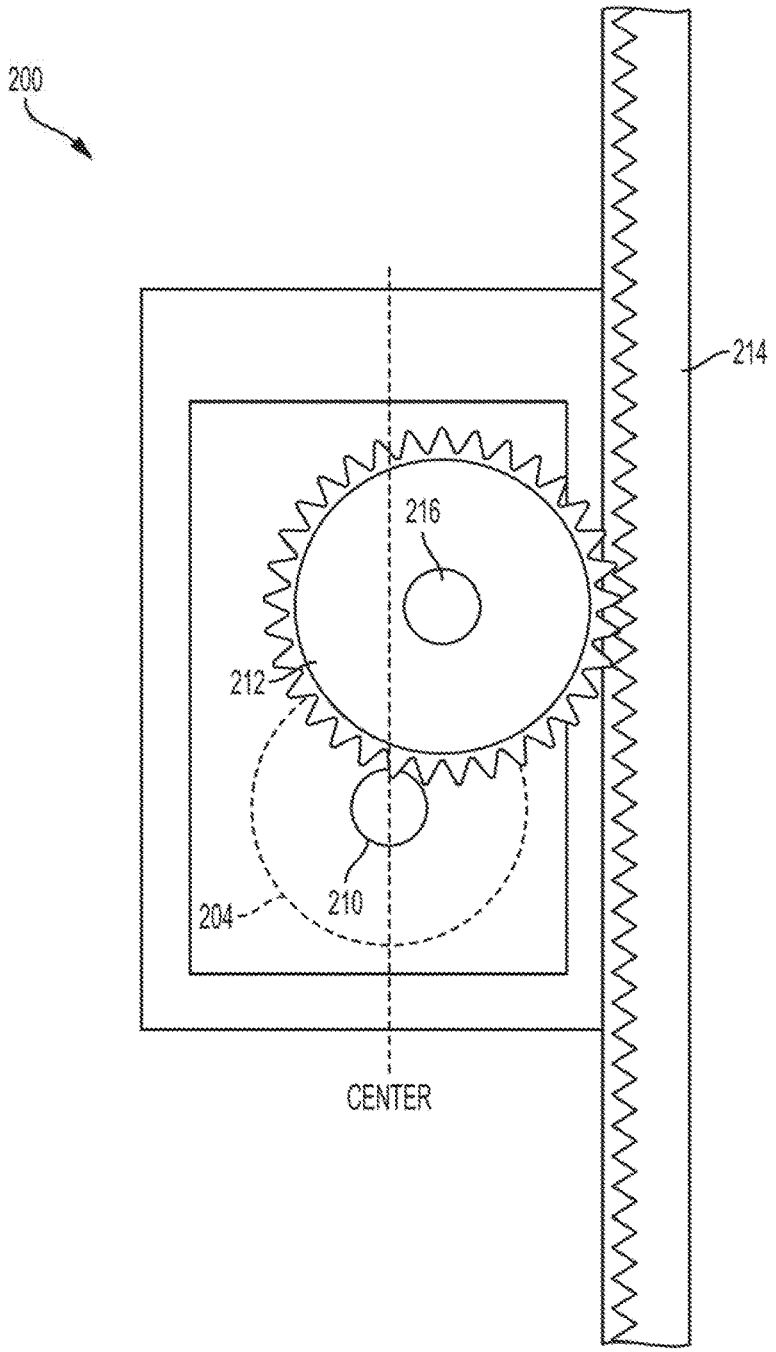
FIG. 8 is a diagrammatic illustration of the end gear meshed with a gear rack, in accordance with an example embodiment of the present invention.

In accordance with an example embodiment of the present invention, the system 200 includes sleeper bearings 250, as depicted in FIGS. 3 and 5. The sleeper bearings 250 run against painting bead and keep the window 202 locked in place and are configured to keep the race or pinion gear 212 from slipping off the gear rack 214. For example, the sleeper bearings 250 ride along a partition within the window sash 218 to keep the sash 218 from shaking during movement. Additionally, the system 200 can further include one or more motor shaft bearings 254, as depicted in FIGS. 3 and 7, mounted proximate to the motor 204. The motor shaft bearings 254 are configured to prevent the main shaft 216 from flexing, bending, or warping during operation.

Figure 11A:
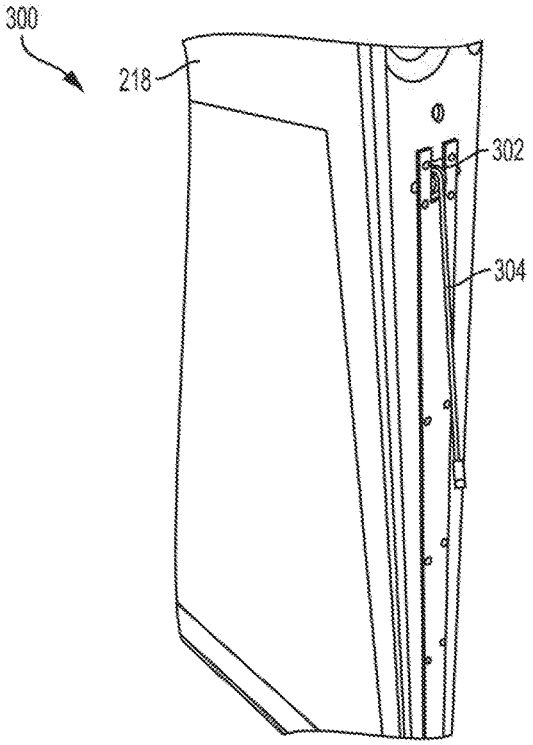
FIGS. 11A and 11B show images of a hidden balance system, in accordance with an example embodiment of the present invention.
Figure 11B:
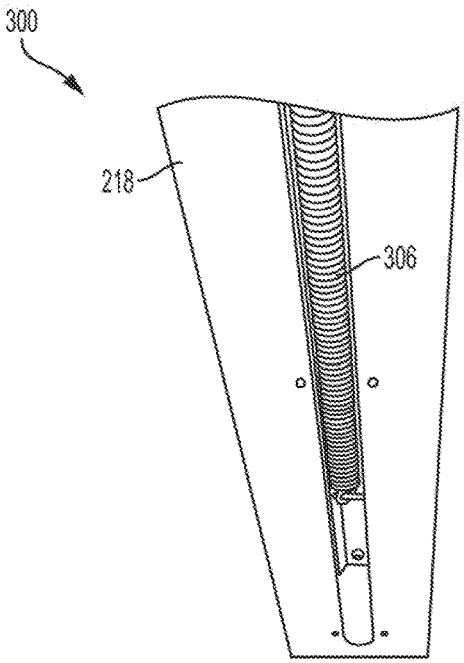

FIGS. 11A and 11B depict components of a hidden balance system 300. FIGS. 11A and 11B depict alternate views of the hidden balance system 300. The system 300 can be implemented a number of different ways that result in lessening a force required to lift a sash 218 of the window 202. In the illustrative embodiment, the hidden balance system 300 includes a pulley 302 and cable 304 in combination with a tension spring 306. The cable 304 is fixed to the frame of the window 202, near a base of the window 202 at a catch 308 (see FIG. 9, e.g., catch 308 shown below electrically conductive roller ball 222). As depicted in FIG. 9, the catch 308 is imbedded in a side jamb 252 of the window 202. As the sash 218 is lowered to the fully closed position, the cable 304 is in tension and pulls on the tension spring 306, extending the spring 306. With the window 202 fully closed, the spring 306 applies a force to the sash 218 via the cable 304, lessening the force required to move the window sash 218 upward. A corresponding system 300 can also be implemented in a top window sash 218, wherein the cable 304 and spring 306 are in tension when the top sash 218 is lowered, and are less in tension when the top sash 218 is in a closed position. The placement of the cable 304, spring 306, and attachment to the frame, are all understood by those of skill in the art with the benefit of the present description and figures.

As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about", "generally", and "approximately" are intended to cover variations that may existing in the upper and lower limits of the ranges of subjective or objective values, such as variations in properties, parameters, sizes, and dimensions. In one non-limiting example, the terms "about", "generally", and "approximately" mean at, or plus 10 percent or less, or minus 10 percent or less. In one non-limiting example, the terms "about", "generally", and "approximately" mean sufficiently close to be deemed by one of skill in the art in the relevant field to be included. As utilized herein, the term "substantially" refers to the complete or nearly complete extend or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A motorized system for opening and closing a window, the system comprising:

a motor, disposed inside a rail of a window sash of a window, comprising a drive shaft, disposed within and configured for mounting inside the rail of the window sash of the window;

at least one main shaft configured for mounting inside the rail of the window sash and mechanically coupled with the drive shaft when in operable configuration;

a gear disposed at a first end of the main shaft, distal from the motor;

a corresponding gear receiver configured for mounting along the window channel of the window frame within which the window sash is slidably mounted, wherein the gear receiver meshes with the gear;

a hidden balance system comprising a pulley and cable in combination with a tension spring, wherein when the window sash is lowered to a fully closed position, the cable is in tension and pulls on the tension spring, extending the tension spring, and wherein when the window is fully closed, the spring applies a force to the window sash via the cable, lessening a force required to move the window sash upward;

wherein when mounted inside the window in operable configuration, the motor comprising the drive shaft moves the window along infinitely variable positions between open and closed.

2. The system of claim 1, wherein the window comprises a double-hung window configuration having the window sash slidably coupled with a window channel of a window frame.

3. The system of claim 1, wherein the gear comprises a race or pinion gear and the gear receiver comprises a gear rack.

4. The system of claim 1, further comprising a power source configured for mounting inside the window sash in electrical communication with the motor.

5. The system of claim 1, further comprising a wireless communication and control device operably coupled with the motor, the wireless communication and control device configured to communicate wirelessly with a remote control and control operation of the motor in accordance with wireless signals received from the remote.

6. The system of claim 5, wherein the wireless communication and control device is operable to control the direction and position of the motor comprising the drive shaft.

7. The system of claim 5, wherein the remote control comprises an application operating on a mobile device.

8. The system of claim 1, further comprising at least two limit switches configured to control an operation of the window in both the up and down positions;

wherein the at least two limit switches break the forward current to the motor when a small stop block depresses at least one of the at least two limit switches.

9. The system of claim 1, wherein the motor is electrically coupled with a power source via an electrically conductive roller ball in contact with a brass strip embedded in a side of the window sash;

wherein the power source electrically couples with the roller ball, which in turn makes rolling contact with the brass strip, which in turn is electrically coupled with the motor.

10. The system of claim 1, wherein the motor is coupled with a safety control configured to monitor motor activity and stop or reverse motor direction when resistance is encountered in attempting to move the window sash, wherein increased workload is sensed by the safety control, and the safety control shuts off power to the motor, thereby halting movement of the window sash whenever there is something obstructing a pathway of the window sash, providing a safety mechanism;

wherein soft stop shock absorbers are disposed where contact is made when the window sash reaches a fully open position or a fully closed position, such that as the window sash approaches the fully open position or the fully closed position, the soft stop shock absorbers contact first, thus increasing workload on the motor so the safety control shuts off power to the motor; and whereby a user is enabled to manually reverse direction of the window sash, and the system then automatically resets to enable the system to be activated to move the window sash.

11. The system of claim 1, further comprising a backup battery disposed inside the sash in addition to the power source, configured to provide a redundant power source in a power failure to ensure safe operation of the system.

12. A method, comprising:

using a remote control device, sending a signal to a wireless receiver disposed in communication with a motorized system disposed and mounted inside non-glass components of a window sash, the signal indicating a command to the motorized system to move the window to a position ranging between and including fully open and fully closed positions;

the motorized system receiving the signal and activating a motor to implement the received command;

the window moving to the position commanded.

13. The method of claim 12, wherein the window comprises a double-hung window configuration.

14. A double-hung window, comprising:

a window sash slidably coupled with a window channel of a window frame;

a motor comprising a drive shaft, wherein the motor and the drive shaft are mounted inside a rail of the window sash;

a power source mounted inside the window sash in electrical communication with the motor;

at least one main shaft mounted inside the rail of the window sash and mechanically coupled with the drive shaft when in operable configuration;

a race or pinion gear disposed at a first end of the main shaft, distal from the motor;

a gear rack mounted along the window channel of the window frame within which the window sash is slidably mounted, wherein the race or pinion gear meshes with the gear rack.

15. The window of claim 14, further comprising a backup battery disposed inside the sash in addition to the power source, configured to provide a redundant power source in a power failure to ensure safe operation of the system.

16. The window of claim 14, further comprising a wireless communication and control device operably coupled with the motor, the wireless communication and control device configured to communicate wirelessly with a remote control and control operation of the motor in accordance with wireless signals received from the remote control.

17. The window of claim 16, wherein the wireless communication and control device is operable to control the direction and position of the motor.

18. The window of claim 16, wherein the remote control comprises a dedicated hardware device.

19. The window of claim 16, wherein the remote control comprises an application operating on a mobile device.

20. The window of claim 14, wherein the motor is coupled with a safety control configured to monitor motor activity and stop or reverse motor direction when resistance is encountered in attempting to move the window sash, wherein increased workload is sensed by the safety control, and the safety control shuts off power to the motor, thereby halting movement of the window sash whenever there is something obstructing a pathway of the window sash, providing a safety mechanism;

wherein soft stop shock absorbers are disposed where contact is made when the window sash reaches a fully open position or a fully closed position, such that as the window sash approaches the fully open position or the fully closed position, the soft stop shock absorbers contact first, thus increasing workload on the motor so the safety control shuts off power to the motor; and whereby a user is enabled to manually reverse direction of the window sash, and motorized system of the window comprising the motor and the safety control then automatically resets to enable the motorized system to be activated to move the window sash.

* * * * *